US008326191B2

(12) United States Patent
Goto

(10) Patent No.: US 8,326,191 B2
(45) Date of Patent: Dec. 4, 2012

(54) DEVELOPING DEVICE AND IMAGE FORMING APPARATUS

(75) Inventor: Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 197 days.

(21) Appl. No.: 12/755,489

(22) Filed: Apr. 7, 2010

(65) Prior Publication Data

US 2010/0260510 A1 Oct. 14, 2010

(30) Foreign Application Priority Data

Apr. 8, 2009 (JP) ..... 2009-094203

(51) Int. Cl.
*G03G 15/08* (2006.01)

(52) U.S. Cl. ..... 399/281

(58) Field of Classification Search ..... 399/44, 399/55, 254, 272, 281, 285
See application file for complete search history.

(56) References Cited

U.S. PATENT DOCUMENTS

| | | | | |
|---|---|---|---|---|
| 4,572,631 | A * | 2/1986 | Kondo | 399/272 |
| 4,809,034 | A * | 2/1989 | Murasaki et al. | 399/253 |
| 6,072,975 | A * | 6/2000 | Kyung | 399/281 |
| 6,560,430 | B2 * | 5/2003 | Muto et al. | 399/255 |
| 6,801,740 | B2 * | 10/2004 | Ito et al. | 399/284 |
| 7,058,344 | B2 * | 6/2006 | Mizutani et al. | 399/281 |
| 7,277,666 | B2 * | 10/2007 | Kawano et al. | 399/281 |
| 7,706,729 | B2 * | 4/2010 | Tsunoda | 399/281 |
| 7,860,437 | B2 * | 12/2010 | Kakuta et al. | 399/281 |

FOREIGN PATENT DOCUMENTS

| | | | |
|---|---|---|---|
| JP | 57064759 | A * | 4/1982 |
| JP | 58154864 | A * | 9/1983 |
| JP | 02039177 | A * | 2/1990 |
| JP | 08006387 | A * | 1/1996 |
| JP | 08124044 | A * | 5/1996 |
| JP | 10268638 | A * | 10/1998 |
| JP | 11-015246 | | 1/1999 |
| JP | 2005062234 | A * | 3/2005 |
| JP | 2007241156 | A * | 9/2007 |
| JP | 2008197321 | A * | 8/2008 |

* cited by examiner

*Primary Examiner* — Robert Beatty
(74) *Attorney, Agent, or Firm* — Kubotera & Associates, LLC

(57) ABSTRACT

A developing device includes a developer supporting member for supplying developer to an image supporting member; a developer supplying member for supplying developer to the developer supporting member; and a stirring member disposed to be freely rotatable. The stirring member includes a free end portion arranged to contact with the developer supplying member and a stirring section for stirring developer when the stirring member rotates.

18 Claims, 6 Drawing Sheets

| Environmental level value | 1 | 2 |
|---|---|---|
| Stirring member application voltage (V) | -100 | -330 |

DEVELOPING DEVICE AND IMAGE FORMING APPARATUS

BACKGROUND OF THE INVENTION AND RELATED ART STATEMENT

The present invention relates to a developing device and an image forming apparatus including the developing device.

In a conventional image forming apparatus of an electrophotography type such as a printer, a facsimile, a copier, and the likes, an image is formed through a charging process, an exposure process, a developing process, a transfer process, a fixing process, and a cleaning process. In the developing process, after a static latent image is formed on a photosensitive drum as an image supporting member, a developing unit as a developing device develops the static latent image using toner as developer, thereby forming a toner image.

In the conventional developing device, in order to reduce a size and a cost of the printer, toner formed of one non-magnetic component is used. In the conventional developing device, a developing roller is disposed to abut against the photosensitive drum. Further, a toner regulation blade is pressed against the developing roller for forming a thin layer of toner on the developing roller. Further, the conventional developing device includes a toner supply roller formed of a foam member for supplying toner to the developing roller and scraping off toner on the developing roller not used in the developing process, an auxiliary roller for supplying toner to the toner supply roller, and the like. (Refer to Patent Reference)

Patent Reference: Japanese Patent Publication No. 11-15246

In the conventional developing device described above, when an image is continuously formed using only a small amount of toner, that is, an image with a low density is continuously formed, toner on the developing roller and the toner supply roller tends to be excessively charged to a large extent. As a result, a stain may be occurs on the photosensitive drum in a non-image forming area thereof.

In view of the problems described above, an object of the present invention is to provide a developing device and an image forming apparatus having the developing device capable of solving the problems of the conventional developing device and preventing a stain form occurring on an image supporting member in a non-image forming area thereof.

Further objects and advantages of the invention will be apparent from the following description of the invention.

SUMMARY OF THE INVENTION

In order to attain the objects described above, according to an aspect of the present invention, a developing device includes a developer supporting member for supplying developer to an image supporting member; a developer supplying member for supplying developer to the developer supporting member; and a stirring member disposed to be freely rotatable. The stirring member includes a free end portion arranged to contact with the developer supplying member and a stirring section for stirring developer when the stirring member rotates.

As described above, in the aspect of the present invention, the developing device includes the developer supporting member for supplying developer to the image supporting member; the developer supplying member for supplying developer to the developer supporting member; and the stirring member disposed to be freely rotatable. The stirring member includes the free end portion arranged to contact with the developer supplying member and the stirring section for stirring developer when the stirring member rotates.

In particular, the stirring member is disposed to be freely rotatable, and includes the free end portion arranged to contact with the developer supplying member. Accordingly, when an image with a low density is continuously formed, it is possible to prevent a stain form occurring on the image supporting member in a non-image forming area thereof, thereby improving image quality.

DETAILED DESCRIPTION OF PREFERRED EMBODIMENTS

Hereunder, embodiments of the present invention will be explained with reference to the accompanying drawings. In the following description, a printer will be explained as an image forming apparatus.

First Embodiment

Figure 1:
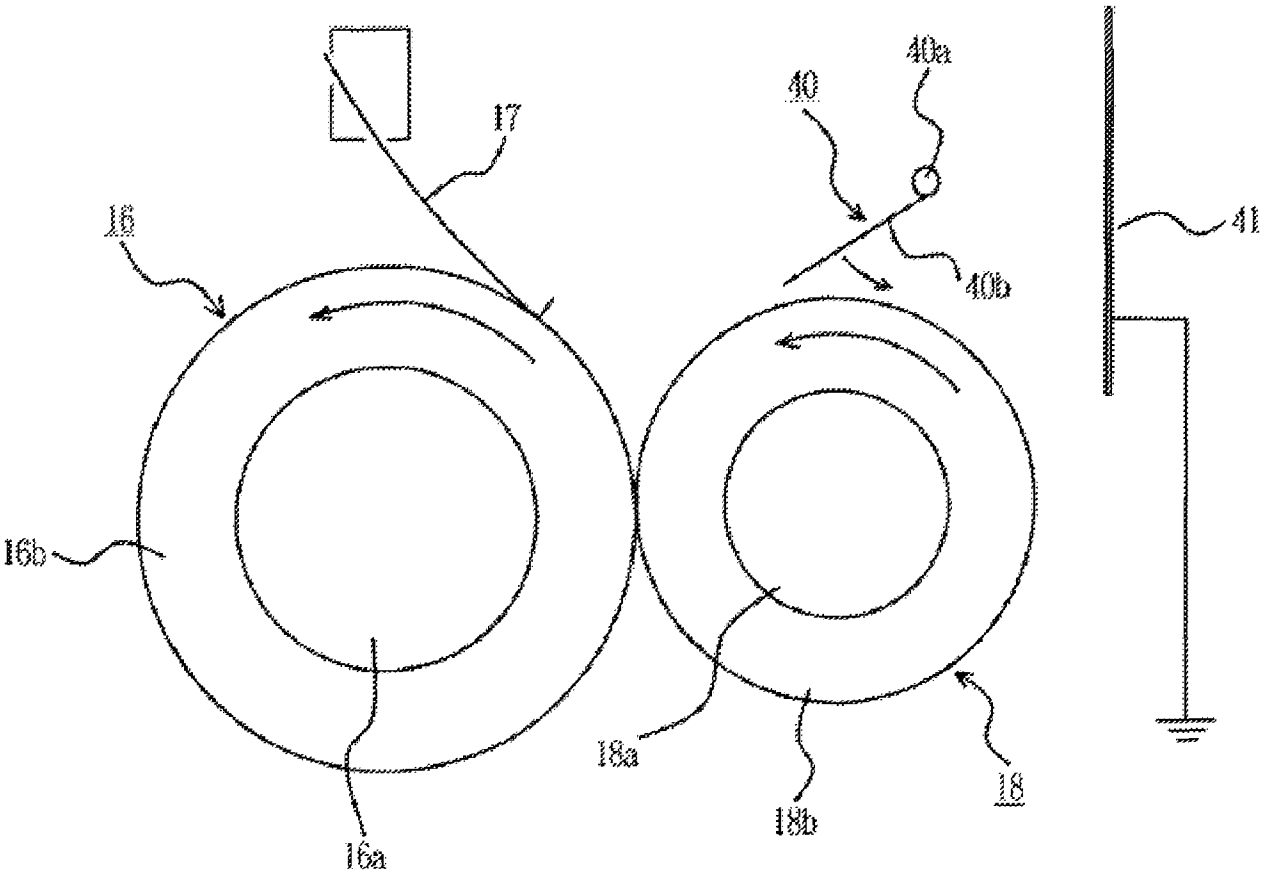
FIG. 1 is a schematic view showing a developing device according to a first embodiment of the present invention.
Figure 2:
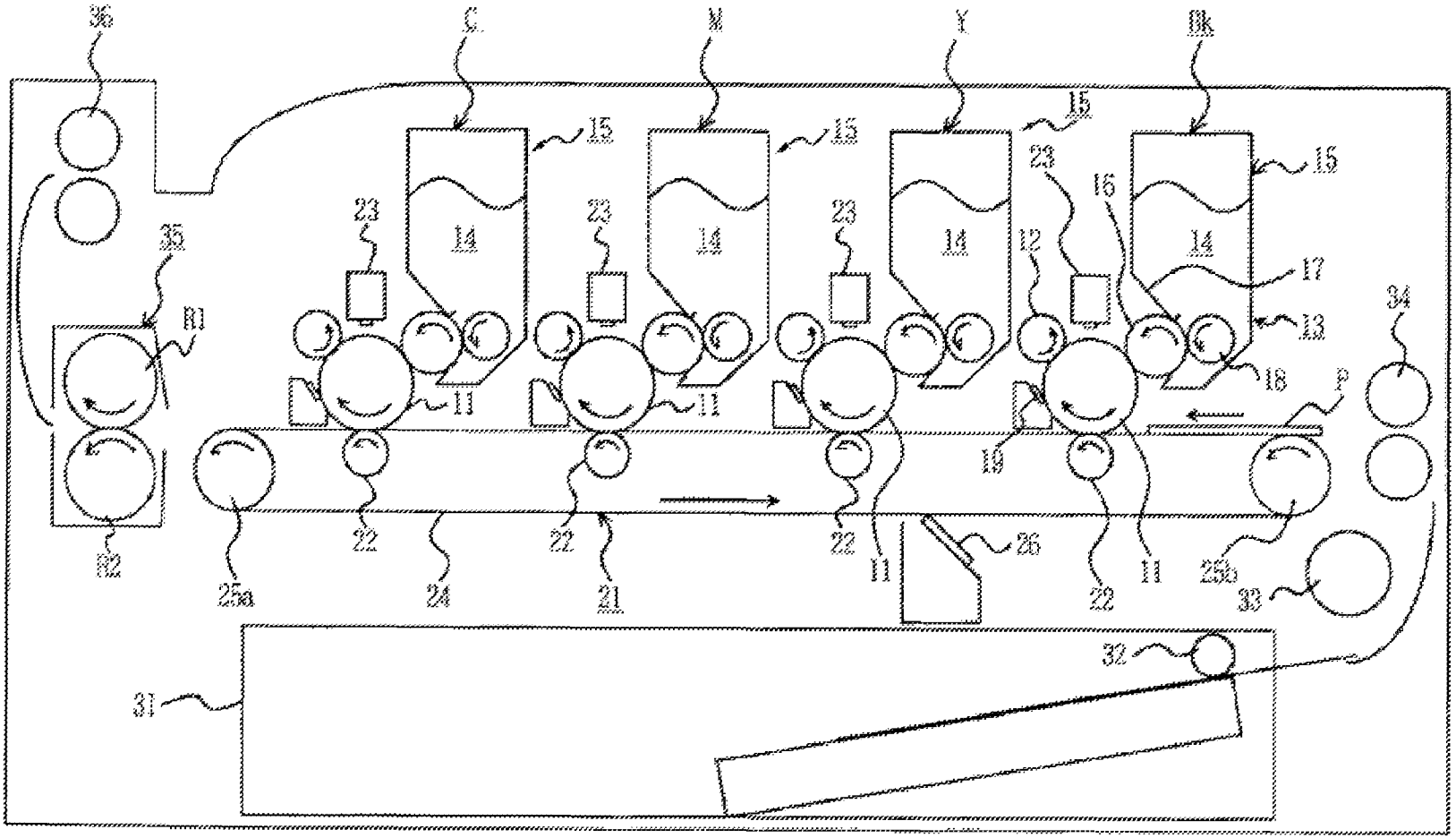
FIG. 2 is a schematic view showing a printer according to the first embodiment of the present invention.

A first embodiment of the present invention will be explained. FIG. 1 is a schematic view showing a developing device according to the first embodiment of the present invention. FIG. 2 is a schematic view showing a printer according to the first embodiment of the present invention.

As shown in FIG. 2, the printer includes image forming portions Bk, Y, M, and C for forming images in four colors (black, yellow, magenta, and cyan). A transfer unit 21 is disposed along the image forming portions Bk, Y, M, and C. Each of the image forming portions Bk, Y, M, and C includes an image forming unit 15 in each color, a photosensitive drum 11 as an image supporting member of the image forming unit 15, and an LED head 23 as an exposure device disposed to face the photosensitive drum 11.

In the embodiment, the image forming unit 15 includes a main body of the image forming unit 15, i.e., an image forming unit main body, and a toner cartridge 13 as a developer storage unit or a developer cartridge detachably attached to the image forming unit main body. The toner cartridge 13 retains toner 14 in each color as developer.

In the embodiment, each of the image forming portions Bk, Y, M, and C includes the photosensitive drum 11 formed in a drum shape and having an organic photosensitive member on a surface thereof. When the LED head 23 exposes the surface of the photosensitive drum 11, a static latent image is formed on the surface of the photosensitive drum 11. A charging roller 12 as a charging device is disposed to contact with the photosensitive drum 11 for uniformly charging the surface of the photosensitive drum 11. Further, each of the image forming portions Bk, Y, M, and C includes a developing device as a developing unit for developing the static latent image to form a toner image, and a cleaning blade 19 as a first cleaning member.

In the embodiment, the developing device includes a developing roller 16 as a developer supporting member disposed to abut against the photosensitive drum 11 for supporting the toner 14 and attaching the toner 14 to the photosensitive drum 11, and a developing blade 17 as a developer regulation member attached to the image forming unit main body and abutting against the developing roller 16 at a distal end portion thereof for regulating a thickness of a toner layer as a developer layer on the developing roller 16.

In the embodiment, the developing device further includes a toner supplying roller 18 as a developer supplying roller disposed at an upstream side of the developing blade 17 in a rotational direction of the developing roller 16 to abut against the developing roller 16 for charging the toner 14 supplied from the toner cartridge 13 and supplying the toner 14 to the developing roller 16. The developing device further includes a stirring member 40 for stirring the toner 14, an electrode plate 41 disposed at a position opposite to the stirring member 40, and the like.

In the embodiment, a drive motor (not shown) as a drive unit of the image forming portions Bk, Y, M, and C is provided for driving a gear (not shown) to rotate the photosensitive drums 11 at a constant circumferential speed in an arrow direction. When the photosensitive drum 11 rotates, the charging roller 12, the developing roller 16, the toner supplying roller 18, a film 40*b* of the stirring member 40 as a stirring element, and the like rotate in arrow directions, respectively.

In the embodiment, the developing roller 16 is formed of a shaft 16*a* and an elastic layer 16*b* covering an outer circumferential surface of the shaft 16*a*. The shaft 16*a* has a diameter of 12.0 mm, and is formed of metal. The elastic layer 16*b* has a thickness of 4.0 mm and a rubber hardness of 70° (Asker C), and is formed of a urethane rubber with semi-conductive property. A surface of the elastic layer 16*b* is processed to adjust friction coefficient, roughness, and charging property thereof.

In the embodiment, the toner supplying roller 18 is formed of a shaft 18*a* and a foam member layer 18*b* covering an outer circumferential surface of the shaft 18*a*. The shaft 18*a* has a diameter of 6.0 mm, and is formed of metal. The foam member layer 18*b* has a thickness of 5.0 mm and a rubber hardness of 50° (Asker F), and is formed of a urethane rubber with semi-conductive property.

In the embodiment, the developing blade 17 is formed of a metal plate such as SUS304 bent in an L character shape. Further, the developing blade 17 has a thickness of about 0.08 mm.

In the embodiment, the stirring member 40 is disposed above the toner supplying roller 18, and is formed of a shaft 40*a* as a rotational axis and the film 40*b*. The shaft 40*a* has a diameter of 2.0 mm, and is formed of metal. The film 40*b* has electrical conductivity, and is formed of a polyimide film having a specific thickness, i.e., about 0.05 mm.

In the embodiment, the film 40*b* has one end portion attached to the shaft 40*a* and the other end portion as a free end portion. The stirring member 40 is arranged such that the film 40*b* is freely rotatable around the shaft 40*a*, and the other end portion of the film 40*b* contacts with the toner supplying roller 18. In other words, when the shaft 40*a* rotates, the other end portion or the free end portion of the film 40*b* repeatedly contacts with and separates away from the toner supplying roller 18.

In the embodiment, the shaft 40*a* is arranged at a position away from the toner supplying roller 18 by a distance of 5.0 mm, and the film 40*b* has a length of 7.0 mm, i.e., a length greater than the distance. Accordingly, a specific portion of the film 40*b* having a length of about 2.0 mm contacts with the toner supplying roller 18.

In the embodiment, in each of the image forming portions Bk, Y, M, and C, the charging roller 12 uniformly charges the surface of the photosensitive drum 11, and the LED head 23 exposes the surface of the photosensitive drum 11 to form the static latent image thereon. Then, the thin layer of the toner 14 on the developing roller 16 is attached to the static latent image, thereby forming the toner image in each color.

In the embodiment, the transfer unit 21 includes transfer rollers 22; a transfer belt 24 as a belt member; a drive roller 25*a* as a first roller; and an idle roller 25*b* as a second roller. The transfer belt 24 is extended with the drive roller 25*a* and the idle roller 25*b* to be freely movable and contact with the photosensitive drums 11. The transfer rollers 22 are disposed to face the photosensitive drums 11 through the transfer belt 24.

In the embodiment, when the transfer belt 24 moves to transport a sheet P as a medium, the transfer rollers 22 sequentially transfer and overlap the toner images in each color to the sheet P, thereby forming a color toner image. After the transfer rollers 22 transfer the toner images to the sheet P, the cleaning blades 19 scrape off and remove the toner 14 remaining on the photosensitive drums 11.

In the embodiment, a sheet supply cassette 31 as a medium storage unit is disposed below the transfer unit 21 for retaining the sheet P. A hopping roller 32 is disposed at a front end portion of the sheet supply cassette 31. The hopping roller 32 picks up the sheet P one by one from the sheet supply cassette 31, so that transportation rollers 33 and 34 transport the sheet toward the image forming portions Bk, Y, M, and C.

In the embodiment, a fixing device 35 is disposed on a downstream side of the image forming portions Bk, Y, M, and C in a transportation direction of the sheet P. The fixing device 35 includes a fixing roller R1 as a first roller and a pressing roller R2 as a second roller. After the sheet P is discharged from the image forming portion C, the fixing device 35 fixes the color toner image to the sheet P, thereby forming a color image. After the color image is formed on the sheet P, a discharge roller 36 discharges the sheet P outside a main body of the printer or an apparatus main body.

The toner 14 will be explained in more detail next. The toner 14 is a crashed-type toner having a negative charging property, and is formed of a binding resin such as a polyester and a colorant such as carbon black, a phthalocyanine copper pigment (C.I. Pigment Blue 15), a quinacridone type pigment (C.I. Pigment Red 122), an anthraquinone type pigment (C.I. Pigment Yellow 185), and the like. The toner 14 has a volume average particle size of 5.8 m. An outer additive is added to the toner 14 per colorant to adjust the charging property of the toner 14.

In the embodiment, an additive such as silica, titanium oxide, alumina, and the like is used. Silica may be subject to a silicone oil process, a disilazane process, and the like. Silica has a primary particle size of 7.0 nm, 12.0 nm, 14.0 nm, 21.0 nm, 40.0 nm, and the like. Silica having different primary particle sizes is mixed at a specific ratio, and is mixed with the toner 14 using a Turbula mixer, a Henschel mixer, and the like.

Figure 3:
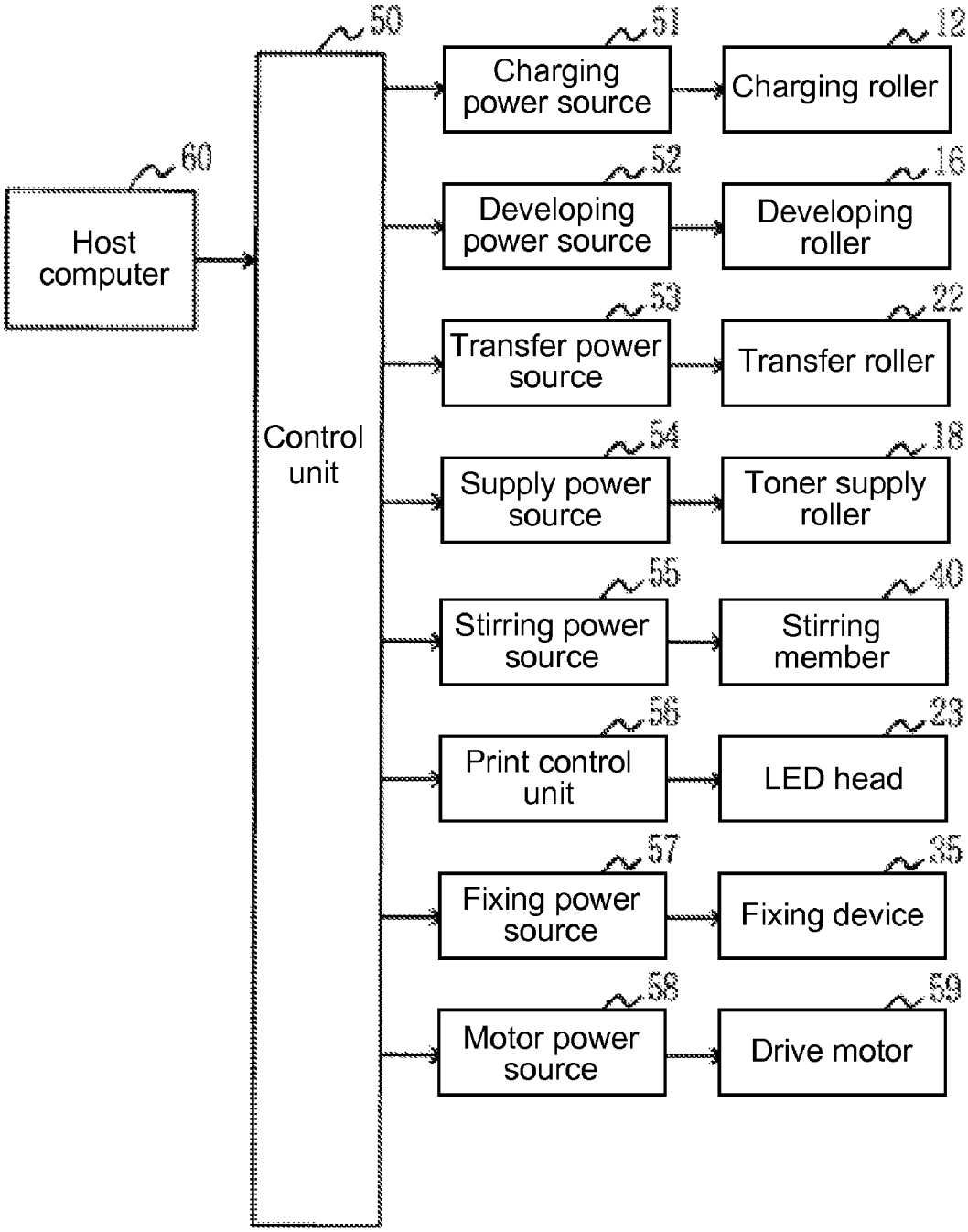
FIG. 3 is a block diagram showing a control system of the printer according to the first embodiment of the present invention.

A control system of the printer will be explained next. FIG. 3 is a block diagram showing the control system of the printer according to the first embodiment of the present invention.

As shown in FIG. 3, the control system of the printer includes a control unit 50 for controlling an entire operation of the printer; a charging power source 51; a developing power source 52; a transfer power source 53; a supply power source 54, and a stirring power source 55.

In the embodiment, the control unit 50 controls the charging power source 51 to apply a voltage to the charging rollers 12; controls the developing power source 52 to apply a voltage to the developing rollers 16; controls the transfer power source 53 to apply a voltage to the transfer rollers 22; controls the supply power source 54 to apply a voltage to the toner supplying rollers 18; and controls the stirring power source 55 to apply a voltage to the stirring members 40.

As shown in FIG. 3, the control system of the printer further includes a print control unit 56 for sending an image signal in each color to the LED heads 23 to drive the LED heads 23; a fixing power source 57 for heating a heating member (not shown) disposed in the fixing roller R1; and a motor power source 58 for driving a drive motor 59 to rotate the photosensitive drums 11, the charging rollers 12, the developing rollers 16, the toner supplying rollers 18, the drive roller 25*a*, the films 40*a*, and the fixing roller R1 in the arrow directions shown in FIGS. 1 and 2.

An operation of the control system of the printer will be explained next. First, when the control unit 50 receives a print command from a host computer 60 as a host device, in a charging process, the control unit 50 sends an instruction to the motor power source 58 to drive the drive motor 59. Accordingly, the photosensitive drums 11 rotate at a specific circumferential speed. Further, the charging power source 51 applies a direct current voltage of −1,150 V to the charging rollers 12 rotating together with the photosensitive drums 11, thereby uniformly charging the surfaces of the photosensitive drums 11.

In the next step, in an exposure process, the control unit 50 sends an instruction to the print control unit 56 to drive the LED heads 23 according to the image signal. Accordingly, the LED heads 23 irradiate light corresponding to the image signal on the surfaces of the photosensitive drums 11, thereby exposing the surfaces of the photosensitive drums 11 and forming the static latent images thereon.

In the next step, in a developing process, the control unit 50 sends an instruction to the supply power source 54 to apply a direct current voltage of −330 V to the toner supply rollers 18. Accordingly, while the toner supply rollers 18 are rotating, the toner 14 retained in the image forming units 15 is supplied to the developing rollers 16. Note that the toner supply rollers 18 rotate in a direction the same as that of the developing rollers 16. Further, a ratio of a circumferential speed of the toner supply rollers 18 relative to a circumferential speed of the developing rollers 16 is set 0.6.

In the next step, when the developing rollers 16 rotate, the developing rollers 16 attract and transport the toner 14. A power source (not shown) applies a direct current voltage of −330 V to the developing blades 17, so that the developing blades 17 form the thin layer of the toner 14 on the developing rollers 16. Note that the developing rollers 16 are pressed against the developing blades 17 with a contact pressure of about 0.8 N/cm.

In the next step, after the toner 14 passes through the developing blades 17, the developing rollers 16 rotate and transport the toner 14 further, so that the static latent images on the photosensitive drum 11 are developed.

In the embodiment, the developing device performs an inversion process. More specifically, the developing power source 52 applies a direct current voltage (a bias voltage) of −200 V between conductive supporting members of the photosensitive drums 11 and the developing rollers 16. At this moment, electrical force lines are created between the photosensitive drums 11 and the developing rollers 16 according to the static latent images formed on the photosensitive drums 11. Accordingly, the toner 14 thus charged on the developing rollers 16 is attached to image forming areas of the photosensitive drums 11 with a static electric force, thereby forming the toner images.

In the embodiment, the toner 14 on the developing rollers 16 corresponding to non-image forming areas of the photosensitive drums 11 is not attached to the photosensitive drums 11 and remains on the developing rollers 16. With the rotation of the developing rollers 16, the toner 14 returns to the developing devices, and is scraped off from the developing rollers 16 through friction between the toner supplying rollers 18 and the developing rollers 16, so that the toner 14 is removed.

As described in "BACKGROUND OF THE INVENTION AND RELATED ART STATEMENT", in the conventional developing device, a stain may occur on the photosensitive drum in the non-image forming area thereof through the following mechanism.

In the conventional printer, when an image with a low density is continuously formed, a large portion of toner on the developing roller is not used and returned to the developing device without moving to the photosensitive drum. Then, toner is scraped off through friction with the toner supply roller, and is removed. When toner on the developing roller is scraped off, and passes through contact portions relative to the toner supply roller and the developing blade, toner is charged through friction. Further, when the toner supply roller rotates to transport toner to the developing roller one more time, toner on the developing roller is further charged through friction upon passing through the contact portions relative to the toner supply roller and the developing blade.

As described above, when an image with a low density is continuously formed, unused toner is repeatedly charged, so that an amount of negative charges in toner increases, thereby increasing an absolute value of a potential of a toner layer. As a result, a difference in surface potentials between the non-image forming area on the photosensitive drum and the image forming area on the photosensitive drum becomes smaller. Accordingly, toner may be attached to the non-image forming area on the photosensitive drum, thereby causing the stain on the photosensitive drum.

To this end, in the embodiment, the stirring member 40 is disposed above the toner supplying roller 18 for stirring the toner 14, and the film 40*b* rotates in the arrow direction shown in FIG. 1 (the same as those of the developing roller 16 and the toner supplying roller 18). In this case, a ratio of a rotational speed of the film 40*b* relative to a rotational speed of the developing roller 16 is set at 0.3.

In the embodiment, a voltage application process unit of the control unit 50 performs a voltage application process. More specifically, the stirring power source 55 applies a direct current voltage of −100 V to the stirring member 40, i.e., the voltage having an absolute value lower than the voltage applied to the toner supplying roller 18 in a negative direction relative to the voltage of the toner supplying roller 18 according to a timing when the toner supplying roller 18 and the film 40*b* rotate.

In the embodiment, the film 40*b* of the stirring member 40 contacts with the surface of the toner supplying roller 18 upon rotating. At this moment, an electric field is created due to a difference between the voltage applied to the toner supplying roller 18 and the voltage (−100 V in the embodiment) applied to the stirring member 40. Accordingly, the toner 14 charged with a negative polarity is attached to the film 40*b* due to the static electric force created with the electric field.

In the embodiment, when the stirring member 40 rotates further, the film 40*b* moves away from the toner supplying roller 18 and is situated at a position facing the electrode plate 41. The electrode plate 41 has a flat plate shape, and faces the stirring member 40 at a position where the toner 14 is stirred. Further, the electrode plate 41 is disposed on a side opposite to the developing roller 16 with the toner supplying roller 18 in between, and is grounded. Accordingly, the toner 14 charged with the negative polarity moves away from the film 40*b* due to a difference between the voltage applied to the stirring member 40 and a potential of the electrode plate 41. Note that when the film 40*b* reaches the position facing the electrode plate 41 upon the rotation of the stirring member 40, the film 40*b* may be capable of contacting with the electrode plate 41.

In the embodiment, when the operation of the stirring member 40 describe above is repeated, the toner 14 on the toner supplying roller 18 charged with the negative polarity is separated from the toner supplying roller 18, and is stirred in the developing device.

In the next step, i.e., the transfer process, when the drive roller 25*a* rotates to move the transfer belt 24, the transfer belt 24 transports the sheet P picked up from the sheet supply cassette 31 to a transfer portion between the image forming portions Bk, Y, M, and C and the transfer unit 21. In the transfer portion, the transfer power source 53 applies the voltage to the transfer rollers 22 disposed to face the photosensitive drums 11, so that the toner images on the photosensitive drums 11 are sequentially transferred to the sheet P, thereby forming the color toner image.

Afterward, the transfer belt 24 further transports the sheet P to the fixing device 35. In the fixing device 35, the color toner image is heated and pressed, so that the color toner image is fixed to the sheet P, thereby forming the color image. Then, the discharge roller 36 discharges the sheet P outside the apparatus main body.

In the embodiment, when a small amount of the toner 14 remains on the photosensitive drum 11, the cleaning blade 19 scrapes off the toner 14, so that the toner 14 is removed from the photosensitive drum 11. Accordingly, the toner 14 is repeatedly used.

An experiment for evaluating an effect of the printer according to the embodiment of the present invention was conducted. In the experiment, the printer performed a continuous printing operation with various print densities, and an occurrence of the stain was compared with that of the conventional printer. In the experiment, the print density is equivalent to a print concentration.

In the experiment, the printer performed the printing operation at the print density with a duty of 0% as a blank printing; the printing operation at the print density with a duty of 10% as a text printing; and the printing operation at the print density with a duty of 20% as an image printing. The sheet P with the A4 size was used, and the continuous printing operation was performed on a specific number of the sheets P at the various printing densities. After the continuous printing operation was performed at each of the print densities, the blank printing was performed to determine whether the stain occurred in the non-image forming area.

A result of the experiment is shown in Table 1. In Table 1, when the stain occurred in the non-image forming area, the result is represented as poor. When the stain did not occur in the non-image forming area, the result is represented as good. The continuous printing operation was performed on 0, 2,500, 5,000, 7,500, 10,000, 12,500, and 15,000 of the sheets P.

TABLE 1

| | 0% duty | | 1% duty | | 10% duty | |
|---|---|---|---|---|---|---|
| Sheets | Conv. | Embod. | Conv. | Embod. | Conv. | Embod. |
| 0 | Good | Good | Good | Good | Good | Good |
| 2,500 | Good | Good | Good | Good | Good | Good |
| 5,000 | Good | Good | Good | Good | Good | Good |
| 7,500 | Poor | Good | Good | Good | Good | Good |
| 10,000 | Poor | Good | Good | Good | Good | Good |
| 12,500 | Poor | Good | Poor | Good | Good | Good |
| 15,000 | Poor | Good | Poor | Good | Good | Good |

Conv.; the conventional printer
Embod.; the printer according to the embodiment

As shown in Table 1, in the conventional printer, when the print density was low and the continuous printing was performed on a large number of the sheets, the stain occurred in the non-image forming area. On the other hand, in the printer according to the embodiment, even when the print density was 0% and the continuous printing was performed on 15,000 of the sheets, the stain did not occur in the non-image forming area.

As described above, in the embodiment, the film 40*b* rotates and contacts with the toner supplying roller 18 in the developing device, and the voltage is applied to the stirring member 40. Accordingly, even when the continuous printing operation is performed at the low print density, it is possible to prevent the stain from occurring on the photosensitive drum 11 in the non-image forming area thereof, thereby improving image quality.

In the embodiment, the stirring power source 55 applies the voltage to the stirring member 40. Alternatively, a film capable of generating the static electric force through friction and being charged may be used as a stirring element. In this case, it is possible to obtain a similar effect without applying the voltage to the stirring member 40 from the stirring power source 55.

Second Embodiment

A second embodiment of the present invention will be explained next. Components in the second embodiment similar to those in the first embodiment are designated with the same reference numerals, and explanations thereof are omitted. The components in the second embodiment similar to those in the first embodiment provide a similar effect.

Figure 4:
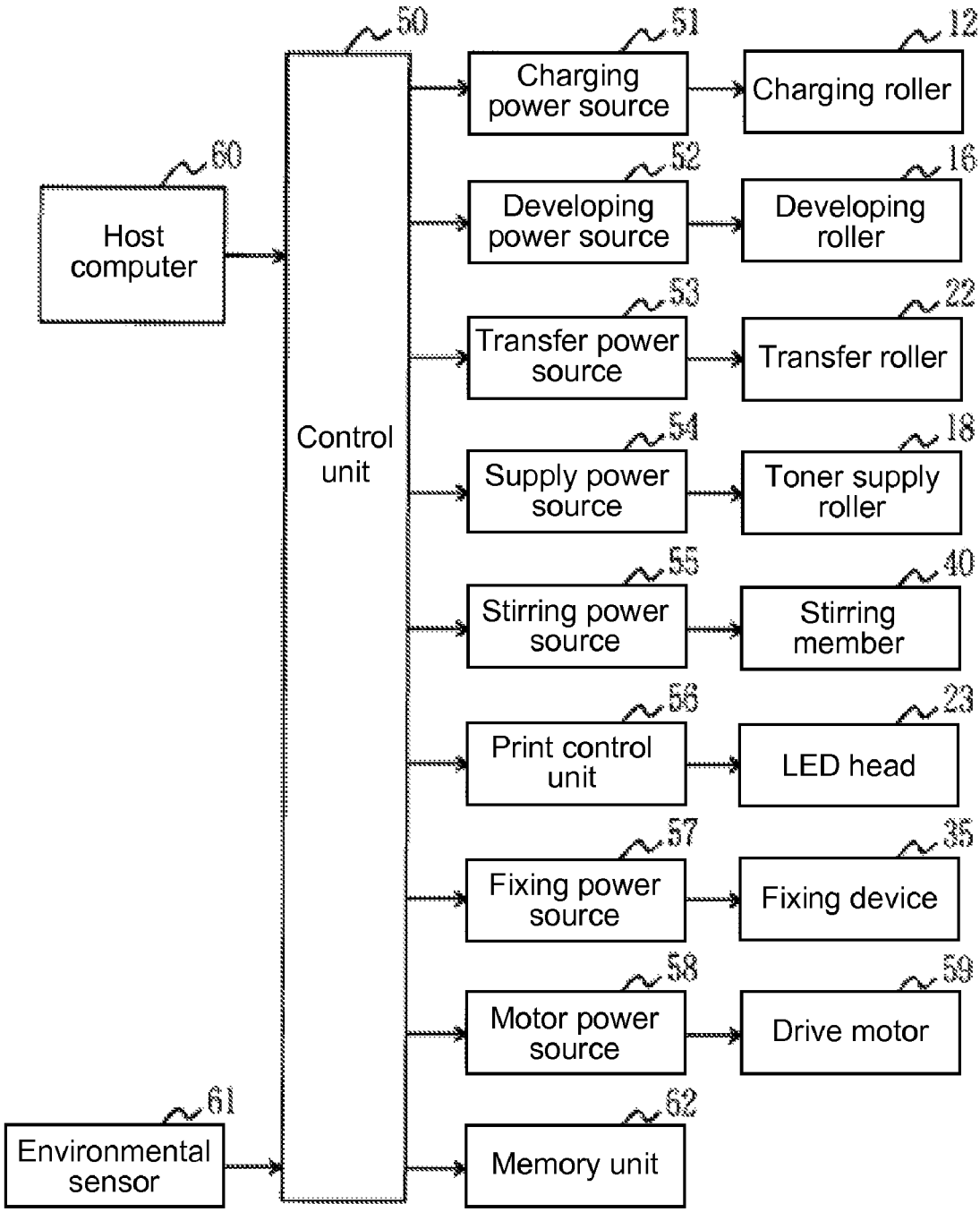
FIG. 4 is a block diagram showing a control system of a printer according to a second embodiment of the present invention.

FIG. 4 is a block diagram showing a control system of a printer according to the second embodiment of the present invention.

As shown in FIG. 4, the control unit 50 is connected to a memory unit 62 and an environmental sensor 61 as an environmental condition detection unit for detecting a temperature and a humidity as an environmental condition in the printer. The memory unit 62 includes an environmental level value table and a stirring member application voltage value table. The environmental level value table stores the temperature and the humidity in the printer, and levels of the temperature and the humidity, i.e., an environmental level value. The stirring member application voltage value table stores the environmental level value and a corresponding voltage to be applied to the stirring members 40.

In the embodiment, an environmental condition determining process unit (not shown) of the control unit 50 performs an environmental condition determining process. More specifically, the environmental condition determining process unit retrieves an output of the environmental sensor 61. Then, the environmental condition determining process unit refers to the environmental level value table, and determines the environmental level value corresponding to the temperature and the humidity in the printer.

In the embodiment, an application voltage determining process unit (not shown) of the control unit 50 performs an application voltage determining process. More specifically, the application voltage determining process unit refers to the stirring member application voltage value table, and retrieves a voltage corresponding to the environmental level value. Afterward, the voltage application process unit controls the stirring power source 55 to apply the voltage corresponding to the environmental condition to the stirring members 40 at a specific timing.

An effect of the temperature and the humidity in the printer on the image quality will be explained next. As described above, in the developing device as the developing unit, the toner 14 as developer is charged mainly through the frictional charging. In general, the frictional charging tends to occur more easily under an environment of a low temperature and a low humidity, and tends to not occur more easily under an environment of a high temperature and a high humidity.

Accordingly, under the environment of a low temperature and a low humidity, a charge amount of the toner 14 increases, and the stain tends to occur more easily in the non-image forming area of the photosensitive drum 11 as the image supporting member. On the other hand, under the environment of a high temperature and a high humidity, for example, when the continuous printing operation is performed at a high density, it is difficult to sufficiently charge the toner 14. As a result, due to an insufficient amount of the toner 14 thus charged, it is difficult to supply a sufficient amount of the toner 14 from the toner supplying rollers 18 as the developer supply roller to the developing rollers 16 as the developer supporting member, thereby causing a blurred image.

In the first embodiment, the stirring member 40 is provided in the developing device for stirring the toner 14 all the time attached to the toner supplying roller 18 and charged with the negative polarity. Under the environment of a high temperature and a high humidity, however, the blurred image may occur on the sheet P as the medium or in the image forming area of the photosensitive drum 11.

To this end, in the second embodiment, under the environment of a low temperature and a low humidity, in which the stain tends to occur in the non-image forming area of the photosensitive drum 11, the voltage is applied to the stirring member 40, so that the toner 14 is separated from the toner supplying roller 18, thereby preventing the stain from occurring in the non-image forming area of the photosensitive drum 11. Under the environment of a high temperature and a high humidity, in which the blurred image tends to occur, the voltage the same as that of the toner supplying roller 18 is applied to the stirring member 40. Accordingly, the toner 14 is not separated from the toner supplying roller 18, and the stirring member 40 only stirs the toner 14.

An operation of the developing device having the configuration described above will be explained next.

Figure 5:
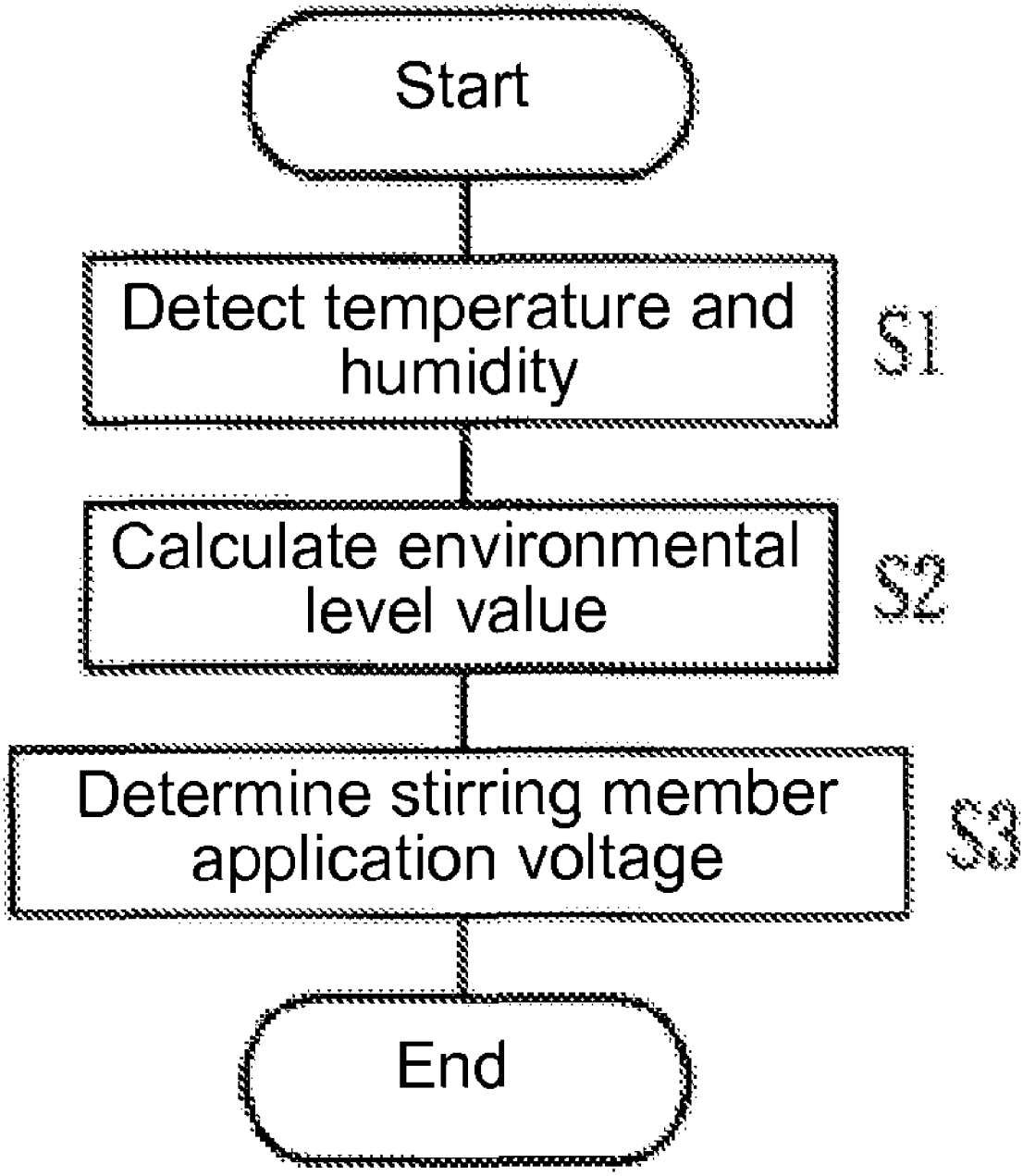
FIG. 5 is a flow chart showing an operation of a developing device according to the second embodiment of the present invention.
Figures 6, 7:
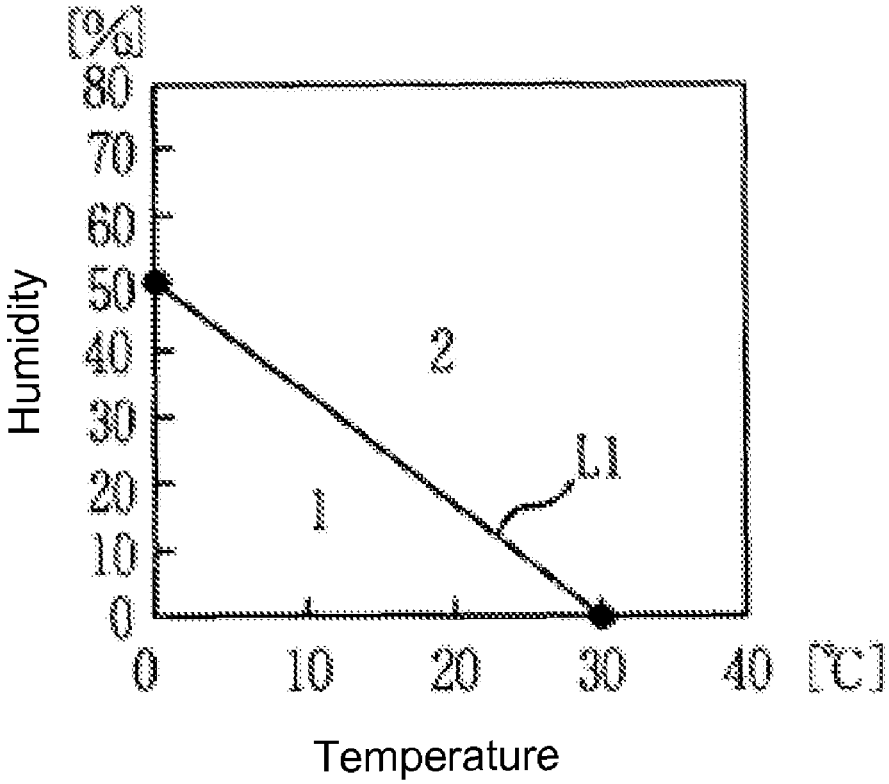
FIG. 6 is a graph showing a relationship between a temperature and a humidity of an environment representing an environmental level value table according to the second embodiment of the present invention.
FIG. 7 is a schematic view showing a stirring member application voltage table according to the second embodiment of the present invention.

FIG. 5 is a flow chart showing the operation of the developing device according to the second embodiment of the present invention. FIG. 6 is a graph showing a relationship between a temperature and a humidity of an environment representing the environmental level value table according to the second embodiment of the present invention. FIG. 7 is a schematic view showing the stirring member application voltage table according to the second embodiment of the present invention.

First, when the control unit 50 receives the print command from the host computer 60 as the host device, the control unit 50 starts a process of determining the voltage to be applied to the stirring member 40.

In the process of determining the voltage, first, the environmental condition determining process unit retrieves the output of the environmental sensor 61. Then, the environmental condition determining process unit refers to the environmental level value table represented with the graph shown in FIG. 6, and determines the environmental level value corresponding to the temperature and the humidity in the printer.

As shown in FIG. 6, an area with the environmental level value of one (1) is separated from an area with the environmental level value of tow (2) with a line L1. For example, when the temperature is 10° C. and the humidity is 10%, the environmental level value is one (1).

In the next step, the application voltage determining process unit refers to the stirring member application voltage value table shown in FIG. 7, and retrieves the voltage corresponding to the environmental level value. Accordingly, the application voltage determining process unit determines the voltage to be applied to the stirring members 40. For example, when the environmental level value is one (1), the voltage to be applied to the stirring members 40 is −100 V.

As described above, in the embodiment, under the environment of the high temperature and the high humidity, it is configured that the voltage the same as that of the toner supplying rollers 18 is applied to the stirring members 40. Accordingly, it is possible to supply a large amount of the toner 14 from the toner supplying rollers 18 to the developing rollers 16. Further, the toner 14 thus charged with the negative polarity is not separated from the toner supplying rollers 18. As a result, it is possible to prevent the blurred image from forming in the image forming areas of the photosensitive drums 11.

An experiment for evaluating an effect of the printer according to the second embodiment of the present invention was conducted as compared with the printer according to the first embodiment of the present invention. In the experiment, the printer performed the continuous printing operation with the various print densities and various environmental conditions, and the stain and the blurred image were evaluated.

In the experiment, the printer performed the printing operation at the print density with the duty of 0% as the blank printing; the printing operation at the print density with the duty of 10% as the text printing; and the printing operation at the print density with the duty of 20% as the image printing. The sheet P with the A4 size was used, and the continuous printing operation was performed on the specific number of the sheets P at the various printing densities. After the continuous printing operation was performed at each of the print densities, the blank printing was performed to determine whether the stain occurred in the non-image forming areas of the photosensitive drums 11.

In the experiment, when the stain occurred in the non-image forming area, the result is represented as poor. When the stain did not occur in the non-image forming area, the result is represented as good. The continuous printing operation was performed on 0, 2,500, 5,000, 7,500, 10,000, 12,500, and 15,000 of the sheets P. As for the environmental conditions, the environmental condition of the low temperature and the low humidity was at a temperature of 20° C. and a humidity of 10%, and the environmental condition of the high temperature and the high humidity was at a temperature of 40° C. and a humidity of 80%.

Further, in the experiment, after the continuous printing operation was performed at each of the print densities, the printing operation with the duty of 100% was performed continuously on thirty sheets to determine whether the blurred image occurred in the image forming areas of the photosensitive drums 11. When the blurred image occurred in the image forming areas, the result is represented as poor. When the blurred image did not occur in the image forming areas, but the image on the sheet P had a decreased density at a lower portion thereof, the result is represented as fair. When the blurred image did not occur in the image forming area, the result is represented as good.

In the experiment, the lower portion of the sheet P corresponded to a portion below a position away from an upper end portion of an image by a sum of a circumferential distance of the developing roller 16 and a circumferential distance of the toner supplying roller 18. When the developing roller 16 and the toner supplying roller 18 rotated one revolution, the image was formed with the toner 14 attached to the photosensitive drum 11 in a portion above the lower portion of the sheet P. Accordingly, the density tended to not decrease. When the developing roller 16 and the toner supplying roller 18 rotated more than two revolutions, the image was formed with the toner 14 attached to the photosensitive drum 11 in a portion below the lower portion of the sheet P. Accordingly, the density tended to decrease.

A result of the experiment with respect to the occurrence of the stain in the non-image forming area is shown in Table 2.

TABLE 2

| | 0% duty | | 1% duty | | 10% duty | |
|---|---|---|---|---|---|---|
| Sheets | Embod. 1 | Embod. 2 | Embod. 1 | Embod. 2 | Embod. 1 | Embod. 2 |
| | Low temperature low humidity | | | | | |
| 0 | Good | Good | Good | Good | Good | Good |
| 2,500 | Good | Good | Good | Good | Good | Good |
| 5,000 | Good | Good | Good | Good | Good | Good |
| 7,500 | Good | Good | Good | Good | Good | Good |
| 10,000 | Good | Good | Good | Good | Good | Good |
| 12,500 | Good | Good | Good | Good | Good | Good |
| 15,000 | Good | Good | Good | Good | Good | Good |
| | High temperature high humidity | | | | | |
| 0 | Good | Good | Good | Good | Good | Good |
| 2,500 | Good | Good | Good | Good | Good | Good |
| 5,000 | Good | Good | Good | Good | Good | Good |
| 7,500 | Good | Good | Good | Good | Good | Good |
| 10,000 | Good | Good | Good | Good | Good | Good |
| 12,500 | Good | Good | Good | Good | Good | Good |
| 15,000 | Good | Good | Good | Good | Good | Good |

Embod. 1; the printer according to the first embodiment
Embod. 2; the printer according to the second embodiment As shown in Table 2, in the printers according to the first embodiment and the second embodiment, the stain did not occur in the non-image forming area.

A result of the experiment with respect to the occurrence of the blurred image in the non-image forming area is shown in Table 3.

TABLE 3

| | 0% duty | | 1% duty | | 10% duty | |
|---|---|---|---|---|---|---|
| Sheets | Embod. 1 | Embod. 2 | Embod. 1 | Embod. 2 | Embod. 1 | Embod. 2 |
| | Low temperature low humidity | | | | | |
| 0 | Good | Good | Good | Good | Good | Good |
| 2,500 | Good | Good | Good | Good | Good | Good |
| 5,000 | Good | Good | Good | Good | Good | Good |
| 7,500 | Good | Good | Good | Good | Good | Good |
| 10,000 | Good | Good | Good | Good | Good | Good |
| 12,500 | Good | Good | Good | Good | Good | Good |
| 15,000 | Good | Good | Good | Good | Good | Good |
| | High temperature high humidity | | | | | |
| 0 | Good | Good | Good | Good | Good | Good |
| 2,500 | Good | Good | Good | Good | Good | Good |
| 5,000 | Good | Good | Good | Good | Good | Good |
| 7,500 | Good | Good | Good | Good | Good | Good |
| 10,000 | Good | Good | Good | Good | Good | Good |
| 12,500 | Fair | Good | Good | Good | Good | Good |
| 15,000 | Poor | Good | Fair | Good | Good | Good |

Embod. 1; the printer according to the first embodiment
Embod. 2; the printer according to the second embodiment As shown in Table 2, in the first embodiment, after the printer performed the continuous printing operation on more than 12,500 sheets at the duty of 0% or 1% under the environmental condition of the high temperature and the high humidity at the temperature of 40° C. and the humidity of 80%, when the printer performed the printing operation at the duty of 100%, the blurred image did occur or the image on the sheet P had the decreased density at the lower portion thereof.

In this case, when the printer performed the continuous printing operation without using a large amount of the toner 14, the toner 14 was deteriorated due to the physical stress, thereby deteriorating the charging property of the toner 14. Under the environmental condition of the high temperature and the high humidity, in which the frictional charging was difficult, the stirring members 40 separated the toner 14 charged with the negative polarity from the toner supplying rollers 18.

In the second embodiment, on the other hand, under the environmental condition of the high temperature and the high humidity, the voltage was applied to the stirring members 40 according to the environmental condition. Accordingly, the stirring members 40 supplied the toner 14 to the toner supplying rollers 18 without separating the toner 14 charged with the negative polarity from the toner supplying rollers 18, thereby preventing the blurred image from being formed in the image forming area.

The flow chart shown in FIG. 5 will be explained next. In step S1, the temperature and the humidity are detected. In step S2, the environmental level value is calculated. In step S3, the stirring member application voltage is determined, thereby completing the process.

In the embodiments described above, the color printer of the electro-photography type is explained as the image forming apparatus. The present invention is applicable to a monochrome printer, a copier, a facsimile, a multi-function product, and the likes.

The disclosure of Japanese Patent Application No. 2009-094203, filed on Apr. 8, 2009, is incorporated in the application.

While the invention has been explained with reference to the specific embodiments of the invention, the explanation is illustrative and the invention is limited only by the appended claims.

What is claimed is:

1. A developing device comprising:

a developer supporting member for supplying developer to an image supporting member;

a developer supplying member for supplying developer to the developer supporting member; and a stirring member disposed to be freely rotatable, said stirring member including a free end portion arranged to contact with the developer supplying member and a stirring section for stirring developer when the stirring member rotates, wherein said stirring section is formed of a film member.

2. The developing device according to claim 1, where said stirring member is arranged to receive a voltage.

3. The developing device according to claim 1, further comprising an electrode plate disposed at a position facing the stirring member for separating developer from the stirring section.

4. The developing device according to claim 3, wherein said electrode plate has a flat plate shape.

5. The developing device according to claim 3, wherein said electrode plate is arranged to be grounded.

6. The developing device according to claim 3, wherein said electrode plate is disposed at a position opposite to the developer supporting member with the developer supplying member in between.

7. The developing device according to claim 3, wherein said stirring member is arranged to contact with the electrode plate when the stirring member rotates.

8. An image forming apparatus comprising the developing device according to claim 1.

9. The image forming apparatus according to claim 8, further comprising a voltage application process unit for applying a voltage to the stirring member.

10. The image farming apparatus according to claim 9, said voltage application process unit is arranged to apply the voltage to the stirring member smaller than that to be applied to the developer supplying member.

11. The image forming apparatus according to claim 9, wherein said voltage application process unit is arranged to apply the voltage with a negative polarity to the stirring member.

12. The image forming apparatus according to claim 8, further comprising an environmental condition detection unit for detecting an environmental condition in the image forming apparatus, said voltage application process unit applying the voltage to the stirring member according to the environmental condition.

13. An image forming apparatus comprising:

a developer supporting member for supplying developer to an image supporting member, said developer supporting configured to rotate at a first rotational speed;

a developer supplying member for supplying developer to the developer supporting member, said developer supplying member being configured to rotate at a second rotational speed;

a rotational member contacting with the developer supplying member to be rotatable, said rotational member being configured to rotate at a third rotational speed smaller than the first rotational speed; and a voltage application process unit for applying a voltage to the rotational member, said voltage having an absolute value smaller than that of a voltage to be applied to the developer supplying member.

14. The image forming apparatus according to claim 13, wherein said rotational member is configured to rotate at the third rotational speed smaller than the second rotational speed.

15. The image forming apparatus according to claim 13, wherein said voltage application process unit is configured to periodically apply the voltage to the rotational member in a specific cycle.

16. A developing device comprising:

a developer supporting member for supplying developer to an image supporting member, said developer supporting member being configured to rotate at a first rotational speed;

a developer supplying member arranged to be rotatable in a first direction for supplying developer to the developer supporting member, said developer supplying member being configured to rotate at a second rotational speed; and a rotational member contacting with the developer supplying member to be rotatable in the first direction, said rotational member being configured to rotate at a third rotational speed smaller than the first rotational seed.

17. The image forming apparatus according to claim 16, wherein said rotational member is configured to rotate at the third rotational speed smaller than the second rotational speed.

18. The image forming apparatus according to claim 16, wherein said voltage application process unit is configured to periodically apply the voltage to the rotational member in a specific cycle.

* * * * *